US009629439B2

(12) United States Patent
Uresti et al.

(10) Patent No.: US 9,629,439 B2
(45) Date of Patent: Apr. 25, 2017

(54) APPLICATOR FOR A COSMETIC PRODUCT AND ASSOCIATED APPLICATOR ASSEMBLY

(71) Applicant: Albea Services, Gennevilliers (FR)

(72) Inventors: Osvaldo Uresti, Paris (FR); Mark Edmondson, Courgains (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 14/519,311

(22) Filed: Oct. 21, 2014

(65) Prior Publication Data

US 2015/0110541 A1 Apr. 23, 2015

(30) Foreign Application Priority Data

Oct. 22, 2013 (FR) ..... 13 60273

(51) Int. Cl.
*A45D 40/26* (2006.01)
*A46B 3/00* (2006.01)
*A46B 9/02* (2006.01)

(52) U.S. Cl.
CPC ..... *A45D 40/265* (2013.01); *A46B 3/005* (2013.01); *A46B 9/021* (2013.01); *A46B 2200/106* (2013.01)

(58) Field of Classification Search
CPC .. A45D 40/262; A45D 40/265; A45D 40/267; A46B 1/00; A46B 3/005; A46B 5/0012; A46B 9/021; A46B 2200/1053; A46B 2200/106
See application file for complete search history.

(56) References Cited

U.S. PATENT DOCUMENTS 3,892,248 A * 7/1975 Kingsford ..... A45D 40/267 132/218
5,775,346 A * 7/1998 Szyszkowski ..... A61C 15/00 132/321
2002/0014251 A1 2/2002 Gueret
2003/0089379 A1* 5/2003 Gueret ..... A45D 34/046 132/218
2004/0244808 A1* 12/2004 Mathiez ..... A45D 40/267 132/218

(Continued)

FOREIGN PATENT DOCUMENTS

EP 1342428 9/2003
FR 2962889 1/2012
JP S6139015 U 3/1986

OTHER PUBLICATIONS

French Application 1360273, Search Report, dated Jun. 19, 2014.

*Primary Examiner* — Jennifer C Chiang
*Assistant Examiner* — Bradley Oliver
(74) *Attorney, Agent, or Firm* — Banner & Witcoff, Ltd.

(57) ABSTRACT

The invention relates to an applicator for a cosmetic product, comprising a core having a first end, referred to as a proximal end, and a second, free end, referred to as a distal end, and a plurality of plates, wherein the plates are moulded with the core, the plates being capable of forming, over the same angular portion of the core, converging channels designed so as to have at least two successive regions of convergence in the same direction of rotation about the core. The invention also relates to an associated applicator assembly.

16 Claims, 3 Drawing Sheets

(56) References Cited

U.S. PATENT DOCUMENTS

| | | | | |
|---|---|---|---|---|
| 2006/0272667 | A1* | 12/2006 | Wyatt | A45D 40/265<br>132/218 |
| 2007/0034223 | A1* | 2/2007 | Dumler | A45D 40/262<br>132/218 |
| 2008/0142034 | A1* | 6/2008 | Manici | A45D 40/262<br>132/218 |
| 2008/0149127 | A1* | 6/2008 | Rebours | A45D 34/042<br>132/218 |
| 2008/0314403 | A1* | 12/2008 | Rebours | A45D 40/262<br>132/218 |
| 2009/0193602 | A1* | 8/2009 | Dumler | A46B 3/005<br>15/160 |
| 2010/0212097 | A1 | 8/2010 | Jeong et al. | |
| 2014/0003857 | A1* | 1/2014 | Gueret | A45D 40/262<br>401/129 |
| 2014/0283868 | A1* | 9/2014 | Zech | A46B 3/005<br>132/218 |
| 2015/0083156 | A1* | 3/2015 | Schuster | A45D 40/262<br>132/218 |
| 2015/0257514 | A1* | 9/2015 | Thierer | A46B 3/005<br>401/122 |

* cited by examiner

APPLICATOR FOR A COSMETIC PRODUCT AND ASSOCIATED APPLICATOR ASSEMBLY

The present application claims priority to, and the benefit of, French Patent Application 1360273 filed Oct. 22, 2013, which is incorporated by reference herein in its entirety.

The invention relates to a cosmetic product applicator and to an associated applicator assembly.

Applicator assemblies for cosmetic products, in particular for cosmetic products to be applied to the eyelashes, such as mascara, comprising a receptacle containing the cosmetic product and an applicator capable of being removably attached to the receptacle, are known.

The receptacle generally comprises a body, the body comprising walls which delimit a container which contains the cosmetic product, and a neck defining an opening through which the cosmetic product can be removed.

The applicator assembly generally comprises a cap capable of being attached to the neck, a rod extending from the cap and an applicator attached to a free end of the rod. The applicator comprises a core and a plurality of protrusions or bristles extending from the core.

When the cap is attached to the neck, the rod and the applicator extend within the container. The applicator is immersed in the cosmetic product contained in the container.

To use the applicator, the user detaches the cap from the neck and removes the applicator from the receptacle.

To prevent the applicator from being overloaded with cosmetic product, the receptacle generally comprises a wiper, attached to the interior of the neck. When the user removes the applicator from the receptacle, the applicator slides within the wiper. The wiper scrapes off excess cosmetic product on the rod and on the applicator.

The wiper thus makes it possible to control the amount of product which is on the applicator and prevents an excessive amount of cosmetic product from being applied to the eyelashes.

The wiper in particular limits the amount of product present on the protrusions. Two parameters interact for this purpose, namely the internal diameter of the wiper and the radial extension of the protrusions. The radial extension of a protrusion means the distance between the axis of longitudinal extension of the core and the free end of the protrusion.

Thus, the desired amount of product on the protrusions when leaving the wiper results from the compromise between the internal diameter of the wiper and the radial extension of the protrusions.

Moreover, it is known that the regions having protrusions having a shorter radial extension promote the loading of the applicator, whereas the regions having protrusions having a longer radial extension promote the combing of the eyelashes.

The prior art places emphasis on applicators allowing the eyelashes to be combed correctly together with the function of separating the eyelashes from one another.

The problem addressed by the present invention is that of proposing an applicator that allows sculpted sections of eyelashes to be produced.

Therefore, the invention relates to an applicator for a cosmetic product, comprising a core having a first end, referred to as a proximal end, and a second, free end, referred to as a distal end, and a plurality of plates projecting from the core.

According to the invention, the plates are moulded with the core, the plates being capable of forming converging channels designed so as to have at least two successive regions of convergence in the same direction of rotation about the core. Two successive regions of convergence means a succession of two regions of convergence, said succession having a discontinuity between said two successive regions of convergence. In other words, the eyelashes are grouped together and then released, in particular when the core rotates by less than 360° in the same direction of rotation, so as to allow the eyelashes to be combed and then loaded with mascara.

The advantage of the applicator of the invention is the option of grouping the user's eyelashes together by making them converge while loading them with cosmetic product. The applicant has indeed noted that the proposed double convergence simultaneously allows optimised grouping and loading of the eyelashes.

According to different embodiments of the invention, which may be taken together or separately:

- the plates are angular disc portions,
- the plates are divided into small plates and large plates,
- the plates are half-discs and/or quarter-discs, forming the large and small plates respectively,
- the plates are inclined relative to a plane orthogonal to a longitudinal direction of extension of the core,
- the large plates are inclined with the same orientation,
- the large plates are parallel to one another,
- the small plates are inclined with the same orientation,
- the small plates are in planes which are parallel to one another,
- the inclination of the large plates is opposite to the inclination of the small plates,
- the large plates alternate with pairs of small plates along the core,
- the plates in the same pair of small plates are in succession at an angle along the same large plate,
- the plurality of plates extends over an angular portion of the core that is substantially equal to 180°,
- the plurality of plates extends between the proximal end and the distal end of the core,
- all the plates project from the core at the same height,
- the applicator further comprises a plurality of protrusions projecting from the core,
- the protrusions are arranged in a plurality of rows extending over an angular portion of the core substantially equal to 180°,
- the rows extend parallel to the axis of the core,
- the core is curved in its extension direction so as to define a concave part and a convex part extending between the proximal and distal ends thereof,
- the plurality of plates extends substantially over the convex part of the core,
- the plurality of protrusions extends substantially over the concave part of the core,
- the core is made of plastics material,
- the protrusions are made of plastics material,
- the plates are made of plastics material,
- the protrusions and the discs are integrally formed with the core,
- the core has a substantially constant cross section from the proximal end to the distal end,
- the core has a substantially circular cross section,
- the core is solid,
- the applicator forms a brush.

The invention also relates to an applicator assembly for a cosmetic product which comprises a receptacle having a body which forms a container intended to contain the cosmetic product, and an applicator as described above that is capable of being attached to the receptacle such that the applicator is housed within the container.

The invention will be better understood and other aims, details, features and advantages thereof will become more apparent upon reading the following detailed explanatory description of at least one embodiment of the invention given purely by way of illustrative and non-limiting example with reference to the accompanying schematic drawings, in which.

Figure 1:
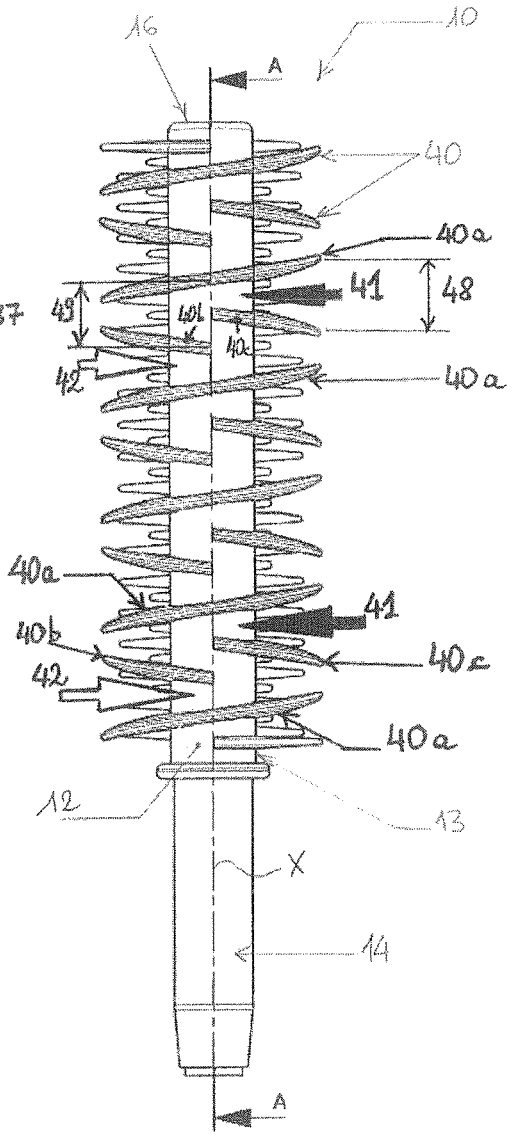
FIG. 1 is an elevated view of an embodiment of an applicator according to the invention.

FIG. 1 shows an applicator 10 for a cosmetic product according to the invention which comprises a core 12 having a first end, referred to as a proximal end 13, and a second, free end, referred to as a distal end 16, and a plurality of plates 40 projecting from the core 12. The core 12 is also extended in this case by a cylindrical coupling 14 for attaching the applicator 10, extending from the proximal end 13 of the core 12.

The plates 40 are moulded with the core 12. In other words, the plates 40 may be integrally formed with the core 12 or over-moulded on the core 12.

This provides interesting options in terms of the shapes for said plates 40.

According to the invention, the plates 40 form channels 41, 42 designed so as to each have at least two successive regions of convergence around the core 12.

In the embodiment in FIG. 1, from the right to the left, the channels provided with reference numeral 41 converge, while, from the left to the right, it is the channels provided with reference sign 42 that converge.

In this way, the applicator may be used equally well for a right eye with the right hand as for a left eye with the left hand, by turning the applicator in the opposite direction, while maintaining the same effect, namely that of grouping the user's eyelashes by making them converge.

In other words, the channels 41, 42 may be convergent or divergent in the direction of rotation observed.

The term 'direction of rotation observed' means the direction of rotation observed by a person looking at the applicator 10 of the invention from a point adjacent to its distal end 16.

The channels 41, 42 are formed by said plates 40. More specifically, said channels 41, 42 are formed by angular disc portions, preferably half-discs 40*a* or quarter-discs 40*b*, 40*c*.

These disc portions 40*a*, 40*b*, 40*c* are inclined relative to a plane orthogonal to the longitudinal direction of extension of the core X.

The channels 41, 42 are in fact each formed by three disc portions: a half-disc 40*a* and two quarter-discs 40*b*, 40*c*, the two quarter-discs 40*b*, 40*c* being in succession at an angle along the half-disc 40*a*, as shown in FIG. 1. The quarter-discs 40*b*, 40*c* have the same inclination, which is opposite to an inclination of the half-disc 40*a*.

The same pattern is repeated along the core 12.

In fact, said plates 40 extend in a repetitive manner, between the proximal end 13 and the distal end 16 of the core.

More specifically, the half-discs 40*a* are inclined with the same orientation, and they are parallel to one another.

The quarter-discs 40*b*, 40*c* are also inclined with the same orientation, and they are in planes which are parallel to one another.

However, the inclination of the half-discs 40*a* is opposite to the inclination of the quarter-discs 40*b*, 40*c*.

It should be noted that the half-discs 40*a* alternate with pairs of quarter-discs 40*b*, 40*c*. In other words, a pair of quarter-discs 40*b*, 40*c* is provided between two half-discs 40*a*.

In addition, two quarter-discs belonging to the same pair of quarter-discs 40*b*, 40*c* are in succession at an angle along the same half-disc 40*a*. In other words, a first quarter-disc 40*b* is terminated in a plane which is also the plane from which the second quarter-disc 40*c* originates; in FIG. 1, this plane is the line A-A.

The user of the applicator 10 a priori makes a gesture so as to rotate said applicator. If the user uses the applicator 10 with their right hand, this gesture is made, still a priori, in the anticlockwise direction (direction of rotation observed). By contrast, if the user uses the applicator 10 with their left hand, this gesture is a priori made in the clockwise direction.

The pattern made by the quarter-discs 40*b*, 40*c* and the half-discs 40*a* along the core 12 allows each channel 41, 42 to group together a section of eyelashes: first, the section of eyelashes is grouped between the half-disc 40*a* and the first quarter-disc 40*b*, said disc portions 40*a*, 40*b* thus forming a first funnel; and second, as the user continues their rotational gesture, said section of eyelashes is released by this first funnel only to be immediately taken up by a second funnel formed between the same half-disc 40*a* and the second quarter-disc 40*c*. This, the eyelashes are efficiently grouped together into sections and are given a pointed appearance.

It should be noted that the opening, or spacing 48, at the start of the first funnel of a channel 41, 42 is the same as the opening, or spacing 49, at the start of the second funnel of the same channel. Said spacings 48, 49 are for example approximately 2 mm.

Therefore, the pattern made by alternating half-discs 40*a* and quarter-discs 40*b*, 40*c* provides the following organisation along line A-A from FIG. 1: a first half-disc 40*a*, spaced by a given distance, in this case approximately 2 mm, from the terminal end of a first quarter-disc 40*b*, which is itself spaced by the same distance from the starting end of the second quarter-disc 40*c* of the same pair of quarter-discs 40*b*, 40*c*, which is itself spaced by the same distance from the following half-disc 40*a*.

It should be noted that, by way of clarification, when the user rotates the applicator of the invention in the anticlockwise direction, the eyelashes are formed into sections by the channels provided with reference numeral 42 in FIG. 1, since said channels 42 are convergent in this direction of rotation as observed. By contrast, when the user rotates the applicator in a clockwise direction, the eyelashes are formed into sections by the channels provided with reference numeral 41 in FIG. 1, since said channels 41 are convergent in this direction of rotation as observed.

The eyelashes are thus grouped together into sections in the manner described above, even if the user changes hands.

The plates 40 project from the core 12 over an angular portion that is substantially equal to 180°, and they therefore only occupy one portion of the radial periphery of the core 12.

According to an alternative embodiment (not shown in the drawings), it is conceivable for said plates 40 to project from the core 12 over its entire radial periphery. This would mean that the applicator 10 thus obtained would not comprise protrusions 30, as will be described in greater detail in the following. This alternative embodiment is compatible with the features of the core 12 as will be specified below, in particular with the feature according to which the core may be straight or curved. The applicator 10 obtained by such an alternative embodiment also has the advantage of allowing the user's eyelashes to be grouped together into sections and giving said eyelashes a pointed appearance, even if said user changes hands.

Moreover, in this case the core 12 has a substantially circular cross section. The core 12 may be provided so to be solid and/or so as to have a substantially constant cross section from its proximal end 13 to its distal end 16.

Figure 3:
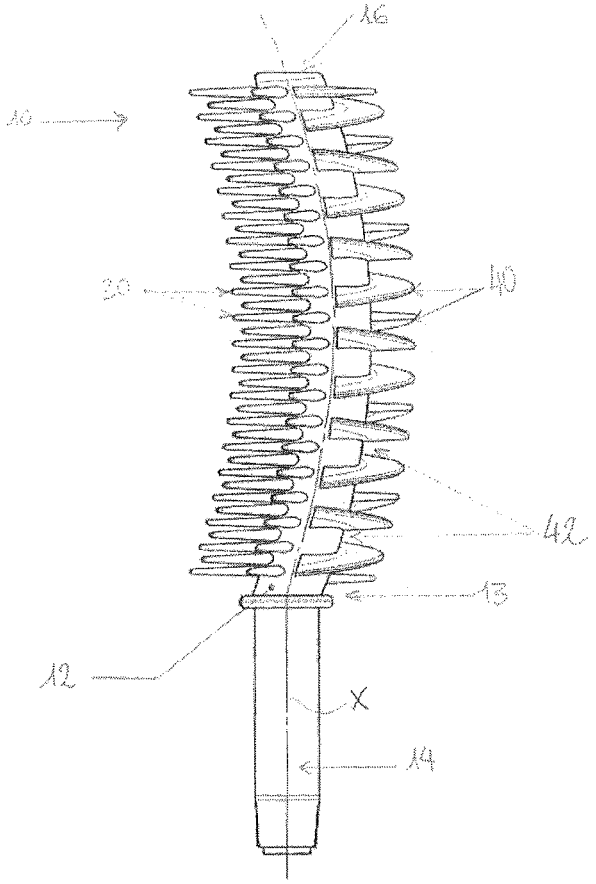
FIG. 3 is an elevated view of the applicator from FIG. 1, having undergone a rotation about a longitudinal axis of extension of the core of said applicator by 90° in the anticlockwise direction.

As can be seen from the drawings, in particular from FIG. 3, the applicator 10 may comprise a plurality of protrusions 30 over the part of the radial periphery of the core 12 that is not occupied by the plates 40. In other words, said plurality of protrusions 30 occupies an angular portion of the core that is substantially equal to 180°, which is complementary to the angular portion occupied by the plates 40 described above.

Figure 4:
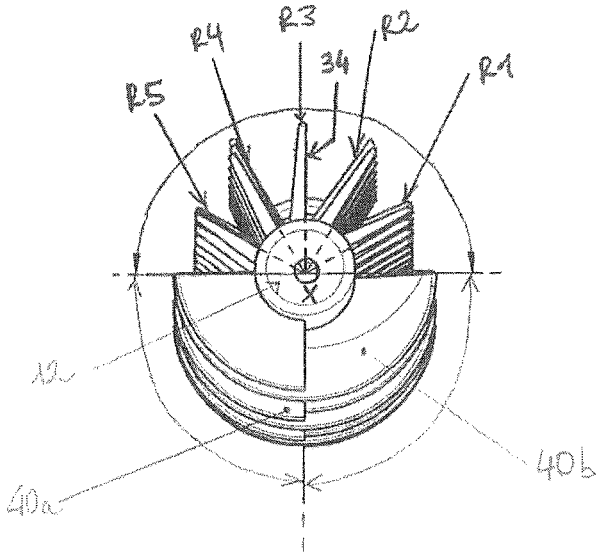
FIG. 4 is a plan view of FIG. 1.
Figure 5:
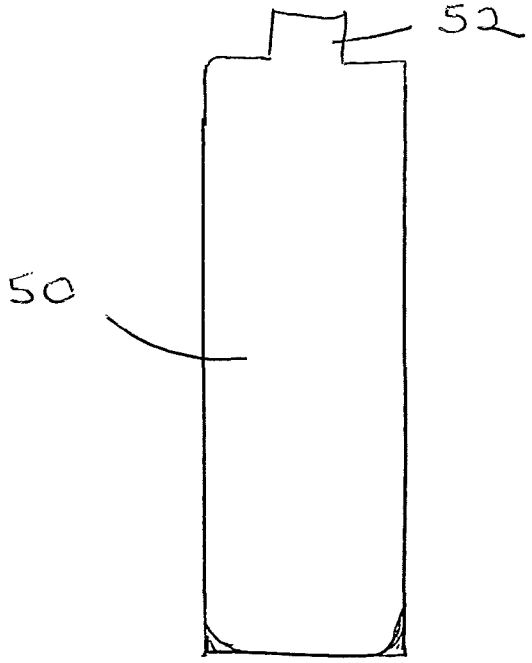
FIG. 5 shows a receptacle having a body and neck in accordance with an aspect of the invention.

Said protrusions 30 project from the core and are arranged in a plurality of rows R1-R5 (see FIG. 4). In this case, the rows R1-R5 have the feature of being parallel to the direction of extension of the core X. The radial spacing between said rows R1-R5 around the periphery of the core 12 is made in accordance with a constant angular distance. Said angular distance is in the range of from 15° to 45°; it is preferably 30°. The embodiment shown here has five rows R1-R5. This number of rows varies depending on the selected angular distance between said rows.

Figure 2:
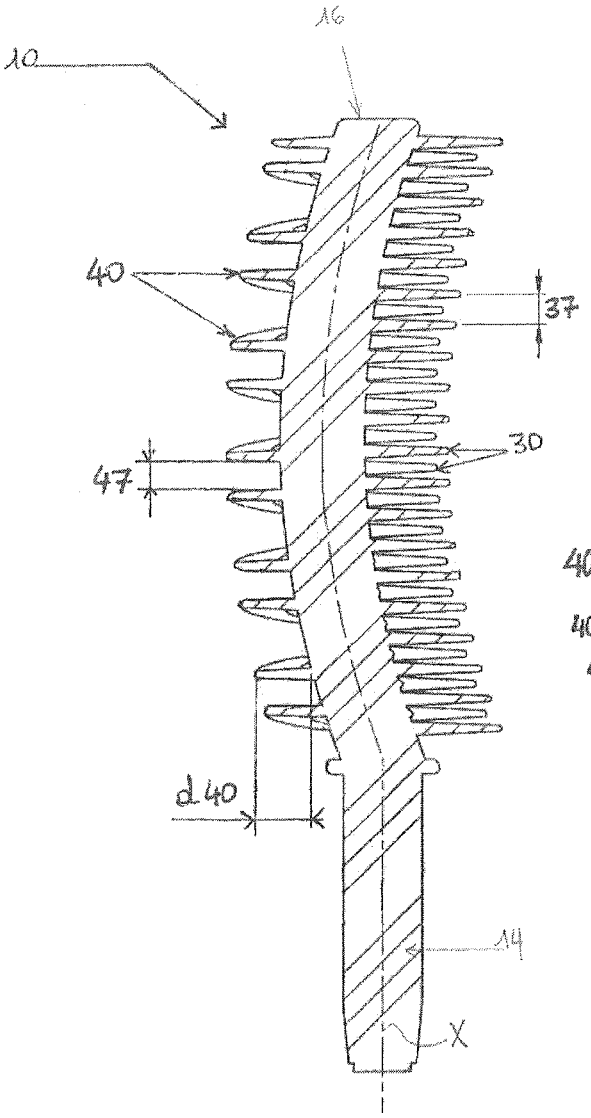
FIG. 2 is a cross section along line A-A shown in FIG. 1.

It should be noted that the protrusions of two adjacent rows are offset axially from one another. Offset means that the protrusions 30 of one row are axially offset from the protrusions 30 in the adjacent rows, said rows R1-R5 having substantially the same spacing 37 between their protrusions 30 of approximately one millimetre, for example (see FIG. 2). Therefore, over the same axial portion, the rows R1-R5 have the same number of protrusions 30, to within one protrusion 30 more or less, for example twenty protrusions 30.

Furthermore, said protrusions 30 preferably have a semi-circular cross section. In this case, the protrusions are positioned so that the planar surfaces 34 of two adjacent protrusions 30 of two different rows are oriented in the same direction of rotation about the core 12 (see FIG. 4). In the example shown, the protrusions 30 in a first row R1 all have a planar face 34 that is oriented radially in a first direction about the core 12, and the planar faces 34 of the protrusions 30 in rows R2 and R4 adjacent to the row R3, for example, are oriented in the same direction about the core 12. In other words, no planar face 34 is opposite another planar face 34.

The moulding of said protrusions 30 with the core 12 is therefore easy, because it allows the use of sliding mould cores which are simple in shape, all have substantially the same shape, and are all oriented radially in the same direction.

The protrusions 30 are advantageously rectilinear and furthermore can be substantially tapered from their base to their free end.

Furthermore, the protrusions 30 are preferably moulded using the same plastics material as the core 12, or integrally formed with the core 12. Therefore, said protrusions 30, like the plates 40 described above, are integrally formed with the core 12. For example, the core 12, the protrusions 30 and said plates 40 can be moulded from a material based on LDPE (low-density polyethylene). Other materials may also be used, namely the material "Exact" from ExxonMobil or the material "Hytrel" from Dupont, or a mixture of these materials. Yet other materials can be used, for example: thermoplastic elastomers (TPE), thermoplastic polyurethane (TPU), styrene-butadiene styrene (SBS) copolymers and styrene-ethylene-butylene-styrene (SEBS), or polyamide (PA).

Said protrusions 30 are all substantially the same length. In other words, the distance between the radial periphery of the core 12 and the free end of the protrusions 30 is substantially the same for all the protrusions 30 that the applicator 10 comprises.

The same applies to the plates 40 which project from the core. Indeed, said plates 40 are all at substantially the same height d40 from the periphery of the core 12. Said height d40 may be in the range of from 1.5 to 3 mm, and is preferably equal to 1.85 mm.

Furthermore, as explained at the outset of the present application, the receptacle generally comprises a wiper to prevent the applicator from being overloaded with cosmetic product when it is removed from the receptacle.

The plates 40, which are in the shape of discs, are wiped to a lesser extent than the protrusions 30 since they are more resistant to bending. They are therefore loaded with a greater amount of cosmetic product than the protrusions 30. Therefore, in addition to their sculpting action, the plates 40 also have the advantage of forming loading regions for consequently loading the user's eyelashes.

Advantageously, the plates 40 do not perform a combing action; this action is performed by the protrusions 30.

It should be noted that the spacing 47 between each half-disc 40*a* and the quarter-disc 40*b* which is adjacent thereto (see FIG. 2) must not be too great, at the risk of producing unsightly sections of eyelashes. Said spacing 47 also cannot be too small, at the risk of the plates 40 no longer having the ability to load the lashes with product.

This spacing 47 is approximately one millimetre, preferably equal to 0.9 mm, at the convergent radial end of said channels.

It should be noted that, in the embodiment described here, the core 12 is curved in its direction of extension so as to define a concave part and a convex part over its periphery.

The plurality of plates 40 extends substantially over the convex part of the core, whereas the plurality of protrusions 30 extends substantially over the concave part of the core.

It is also possible, in another embodiment which is not shown, for the core 12 to be hollow.

It should be noted that the applicator 10 advantageously forms a brush.

The invention also relates to an applicator assembly for a cosmetic product, comprising a receptacle having a body 50 and a neck 52 which forms a container intended to contain the cosmetic product, and an applicator, as described above, suitable for being attached to the receptacle, so that the applicator is housed inside the container. Said applicator 10 is attached, for example, to the end of a rod, the rod itself being attached to a cap that is advantageously screwed to the receptacle. After assembly, the cylindrical coupling 14 is positioned in the rod and the proximal end 13 of the core forms the visible proximal end of the applicator.

It should also be noted that variants are of course possible. In particular, it is also conceivable, in additional embodiments, for the applicator to have a rectilinear, straight or planar core or a core having a polygonal cross section.

As set out above, one region of convergence is made up of pairs of plates 40 which converge on each other in a direction of rotation about the core 12. Said pairs are arranged such that two pairs which are in succession in accordance with a distribution around the core 12 converge in the same direction about the core 12. It should be noted that each plate 40 is part of two pairs of plates 40, said two pairs being in succession in this case in the longitudinal direction of extension of the core 12, one converging in one direction of rotation about the core 12 and the other converging in the other direction of rotation about the core 12.

The invention claimed is:

1. Applicator for a cosmetic product, comprising:

a core having a first end, referred to as a proximal end, and a second, free end, referred to as a distal end, and a plurality of plates projecting from the core, wherein the plates are moulded with the core, wherein the plates are half-discs and quarter-discs, forming large and small plates respectively, the plates configured to form converging channels designed so as to have at least two successive regions of convergence in the same direction of rotation about the core, the at least two successive regions being successive around the core.

2. Applicator according to claim 1, wherein the plates are angular disc portions.

3. Applicator according to claim 1, wherein the plates are inclined relative to a plane orthogonal to a longitudinal direction of extension of the core (X).

4. Applicator according to claim 1, wherein the plurality of plates extends over an angular portion of the core that is substantially equal to 180°.

5. Applicator according to claim 1, wherein the applicator further comprises a plurality of protrusions projecting from the core.

6. Applicator according to claim 5, wherein the protrusions are arranged in a plurality of rows (R1-R5) extending over an angular portion of the core that is substantially equal to 180°.

7. Applicator according to claim 1, wherein the core is curved in its extension direction (X) so as to define a concave part and a convex part.

8. Applicator according to claim 7, wherein the plurality of plates extends substantially over the convex part of the core.

9. Applicator assembly for a cosmetic product, comprising:

a receptacle having a body which forms a container intended to contain the cosmetic product, and an applicator according to claim 1 that is configured to be attached to the receptacle such that the applicator is housed within the container.

10. Applicator assembly according to claim 9, wherein the plates are angular disc portions.

11. Applicator assembly according to claim 9, wherein the plates are inclined relative to a plane orthogonal to a longitudinal direction of extension of the core (X).

12. Applicator assembly according to claim 9, wherein the plurality of plates extends over an angular portion of the core that is substantially equal to 180°.

13. Applicator assembly according to claim 9, wherein the applicator further comprises a plurality of protrusions projecting from the core.

14. Applicator assembly according to claim 13, wherein the protrusions are arranged in a plurality of rows (R1-R5) extending over an angular portion of the core that is substantially equal to 180°.

15. Applicator assembly according to claim 9, wherein the core is curved in its extension direction (X) so as to define a concave part and a convex part.

16. Applicator assembly according to claim 15, wherein the plurality of plates extends substantially over the convex part of the core.

* * * * *